US006973817B2

(12) United States Patent
Galanti

(10) Patent No.: US 6,973,817 B2
(45) Date of Patent: Dec. 13, 2005

(54) MULTI-DIRECTIONAL PULL TOOL AND METHOD OF USING

(76) Inventor: Romeo Galanti, 27 Holly Ave., Runnemeade, NJ (US) 08078

( * ) Notice: Subject to any disclaimer, the term of this patent is extended or adjusted under 35 U.S.C. 154(b) by 23 days.

(21) Appl. No.: 10/796,610

(22) Filed: Mar. 9, 2004

(65) Prior Publication Data

US 2005/0199035 A1 Sep. 15, 2005

(51) Int. Cl.[7] ..... B21J 13/08
(52) U.S. Cl. ..... 72/457; 72/479; 72/705
(58) Field of Search ..... 72/308, 364, 446, 72/457, 460, 476, 479, 705

(56) References Cited

U.S. PATENT DOCUMENTS 1,785,923 A * 12/1930 Wade ..... 73/392
3,241,352 A * 3/1966 Lincourt ..... 72/457
3,338,086 A * 8/1967 Hunter ..... 72/457
4,107,974 A * 8/1978 Kuhn ..... 72/457
4,167,108 A * 9/1979 Jarman et al. ..... 72/477
4,770,025 A * 9/1988 Graf ..... 72/422
5,044,191 A * 9/1991 Combs ..... 72/422
5,233,858 A * 8/1993 Bundy ..... 72/308
5,335,533 A * 8/1994 Rehus ..... 72/422

* cited by examiner

*Primary Examiner*—Ed Tolan
(74) *Attorney, Agent, or Firm*—Stuart M. Goldstein

(57) ABSTRACT

A multi-directional pull tool has a fist-like cylindrical end section from which a elongated boxed shaped second section extends. The tool is designed to attach to the square or rectangular opening at the end of a damaged frame rail. The tool is attached directly to the sidewalls of the frame rail, allowing for a more direct pull of the infrastructure of the frame rail in the opposite direction in which it was hit, thus allowing a cleaner pull and a setting of the control points of the frame rail back in line. The elongated second section comprises a plurality of openings along the length of the section, through which pull chains, via clamps are connected. In this manner, the damaged frame rail can be pulled in the multitude of directions necessary to return the rail to the proper position without the need to change or reposition the clamps and other pulling equipment.

8 Claims, 4 Drawing Sheets

MULTI-DIRECTIONAL PULL TOOL AND METHOD OF USING

BACKGROUND OF THE INVENTION

Many vehicles which have been involved in accidents or collisions and have been severely damaged are often classified as being constructive total losses, because of the excessive repair cost which must be incurred to repair the vehicle. A large part of this cost often includes the amount of time necessary to pull and straighten damaged frame rails and unibody structures. Even where frame rails need to be replaced, the costs are high and substantially add to the overall expense of vehicle repair.

Most prior systems which employ frame rail pull tool devices, either cause damage to the frame rails during the pulling operation and/or require multiple repositioning of equipment. This also contributes to the cost of repairing a vehicle with front end damage far exceeding the actual value of the vehicle. Insurance companies are thus compelled to pay the vehicle owner for the value of the vehicle, rather than paying the repair shop to fix it, which costs are often far less. Nevertheless, pull tool systems remain very valuable in straightening damaged frame rails.

Collision and vehicle body and frame repair shops employ various types of frame rail pull devices, most which use vise-type gripping attachment means which are secured to the edges of the rails. These frame rail pull systems exert tensioning forces to straighten frame rail structures. The tensioning forces are substantial and, as a result, when many of the commonly used pull devices are secured to the frame rails, the tremendous forces required to straighten the rails often cause the pull tools to tear or shear the rails, thus requiring additional repair time and expense.

A different type of frame rail attachment means is found in U.S. Pat. No. 4,916,793, which shows the use of an anchor plate welded to a frame rail. The pulling apparatus is secured to the plate via a pulling chain. However, this system does not allow for multi-directional straightening and its pulling point is restricted to the welding plate which is used. U.S. Pat. No. 5,044,191 shows the use of a pull bar which extends into a frame rail. However, the bar, as disclosed, will not be able to withstand the requisite tension stresses needed to straighten a rail. Also, by this system the frame rail will be severely weakened by the applied tension forces. Further, there is no provision for securing the bar directly to the side walls of the frame rail. The bar also does not permit multi-directional pulling, without making a number of readjustments of the equipment.

SUMMARY OF THE INVENTION

It is thus an object of the present invention to overcome the disadvantages and limitations of prior pull tools and pull tool systems.

It is an object of the present invention to provide a pull tool which is capable of repairing large commercial vehicles, such as heavy trucks and buses.

It is a further object of the present invention to provide a pull tool which, when used to repair a damaged frame rail, need only be positioned on the frame rail once during the entire operation.

It is another object of the present invention to provide a pull tool which can be pulled in the multiple directions necessary to return a damaged frame rail to a straighten position, without the need to change or reposition pulling equipment.

It is a further object of the present invention to provide a pull tool which eliminates the hours of time needed to otherwise breakdown and reset equipment in order to pull a damaged frame rail at different angles.

It is still another object of the present invention to provide a pull tool which will not tear, rip, or shear the metal of the damaged frame rail during the straightening operation.

It is a further object to the present invention to provide a pull tool which is available in several sizes, to repair various frame rail components of many different vehicles.

These and other objects are accomplished by the present invention, a multi-directional pull tool which has a fist-like cylindrical end section from which a elongated boxed shaped second section extends. The tool is designed to attach to the square or rectangular opening at the end of a damaged frame rail. The tool is attached directly to the sidewalls of the frame rail, allowing for a more direct pull of the infrastructure of the frame rail, in the opposite direction in which it was hit, thus allowing a cleaner pull and a setting of the control points of the frame rail back in line. The elongated second section comprises a plurality of openings along the length of the section, through which pull chains, via clamps are connected. In this manner, the damaged frame rail can be pulled in the multitude of directions necessary to return the rail to the proper position without the need to change or reposition the clamps and other pulling equipment.

Novel features which are considered as characteristic of the invention are set forth in particular in the appended claims. The invention, itself, however, both as to its design, construction and use, together with the additional features and advantages thereof, are best understood upon review of the following detailed description with reference to the accompanying drawings.

DETAILED DESCRIPTION OF THE INVENTION

Figure 1:
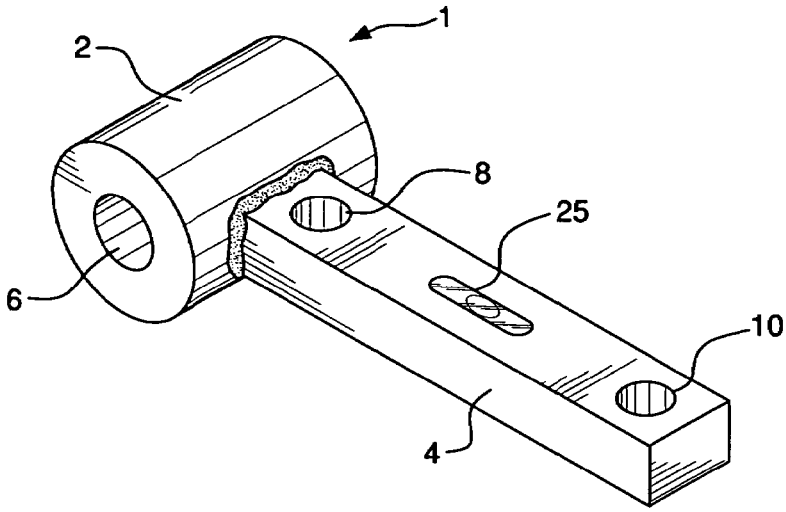
FIG. 1 is an isometric view of the pull tool of the present invention.

The pull tool 1 of the present invention is disclosed as a solid, unitary body comprising a fist-like head section 2, shown as cylindrical in configuration. The shape of section 2, however, is not to be considered restricted to this configuration. Section 2 can be designed rectangularly, boxed shape, or other convenient shape which will fit into the end of the frame rail to be repaired. Extending from section 2 is elongated, boxed-shaped second section 4. Once again, the configuration of section 4 is not restricted as to its shape. It is contemplated that section 4 can be a cylindrically, log-shaped component or other convenient shape.

Section 2 has through-hole 6 which extends the entire length of the section. Section 4 comprises openings 8 and 10 along its width. While two openings are shown, it is contemplated that more than two openings may be employed, as may be a necessary.

Figure 2:
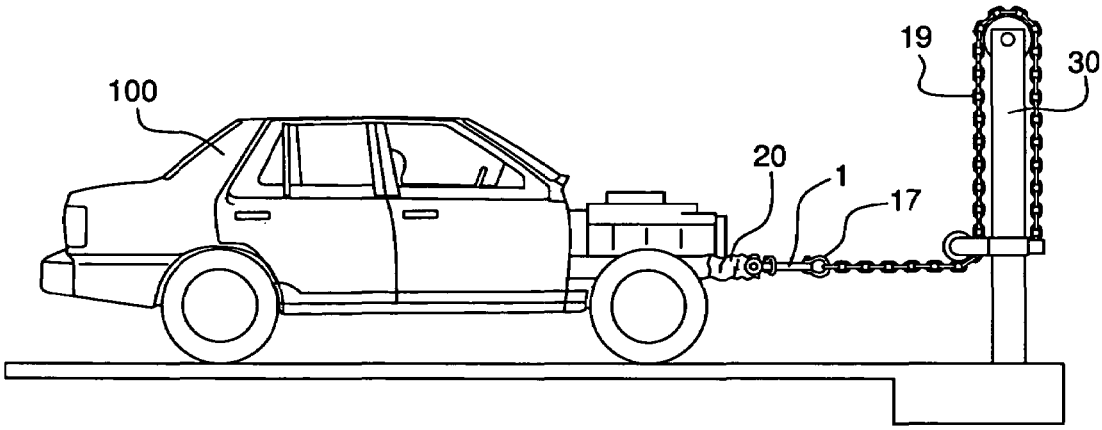
FIG. 2 depicts the positioning of a damaged vehicle, using the pull tool of the present invention.
Figure 3:
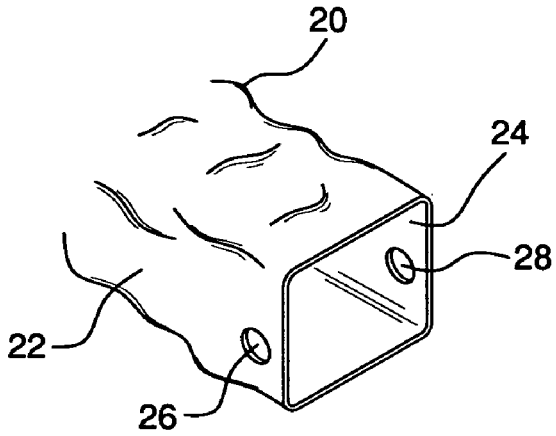
FIG. 3 shows the end of a damaged frame rail.

As seen in FIG. 2, pull tool 1 is to be secured to damaged frame rail 20 of vehicle 100. Clamp 17 connects pull tool 1 to pull chain 19, which runs to and through pull post 30, commonly used in the industry to provide pulling tension to frame rail 20, via pull chain 19 and pull tool 1.

Figure 4:
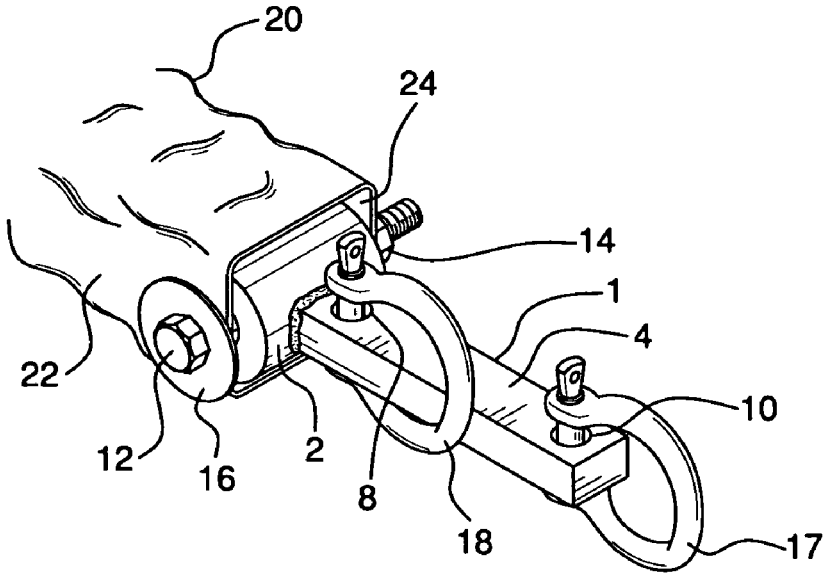
FIG. 4 shows the pull tool of the present invention in position, connected to a damaged frame rail.

With specific reference to FIG. 4, pull tool 1 is shown in position within the end of damaged rail frame 20, which comprises sidewalls 22 and 24. Holes 26 and 28 are provided or are drilled into sidewalls 22 and 24 respectively, and through-hole 6 of pull tool is perpendicularly aligned with the sidewalls and its holes. Elongated bolt 12 is inserted into hole 26, then into through-hole 6 of pull tool 1, and finally through hole 28 of sidewall 24. Nut 14 secures bolt 12 and thus pull tool 1 securely within frame 20. Upon tightening of nut 14, washer 16, which has a rough texture, bites into the sides of frame rail 20. In this manner, pull tool 1 is securely attached to frame 20, but it also has the ability to pivot up or down in relation to frame rail 20, upon loosening and then retightening nut 14. Clamps 17 and 18 are connected to pull tool 1 through holes 8 and 10 respectively. Pull chains 19 and 21 can then be connected to clamps 17 and 18.

Figure 5:
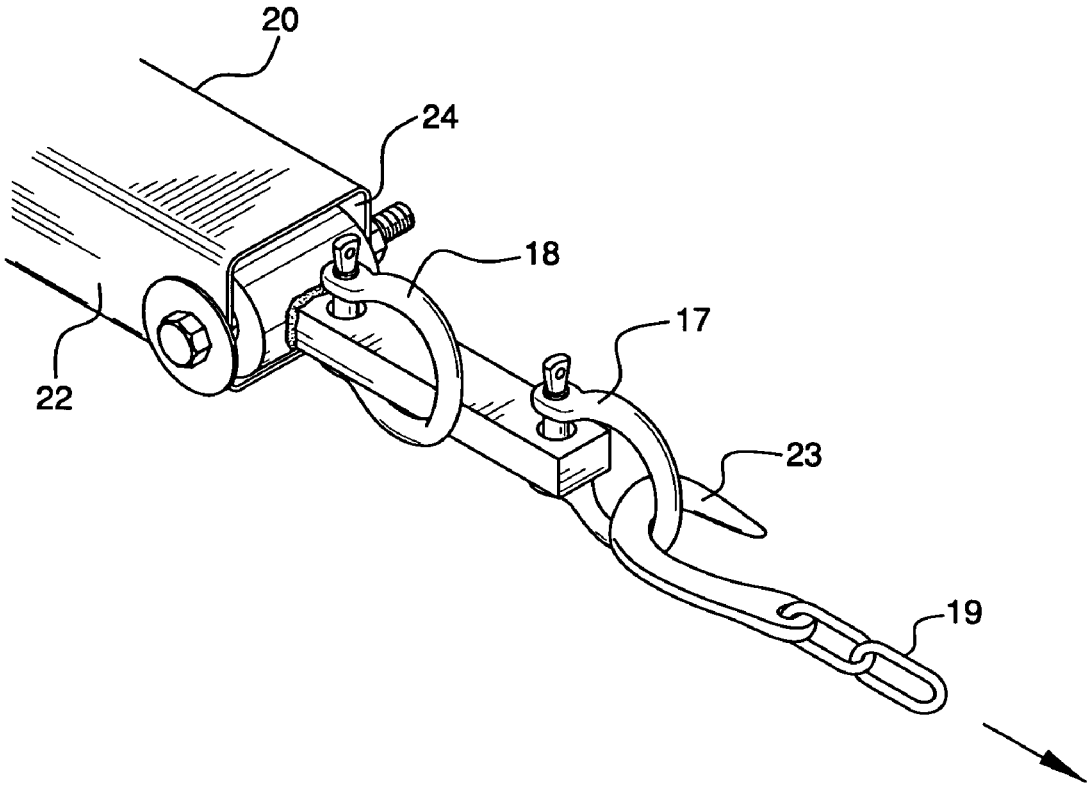
FIG. 5 shows the pull tool of the present invention in pulling mode, as it straightens a frame rail.
Figure 6:
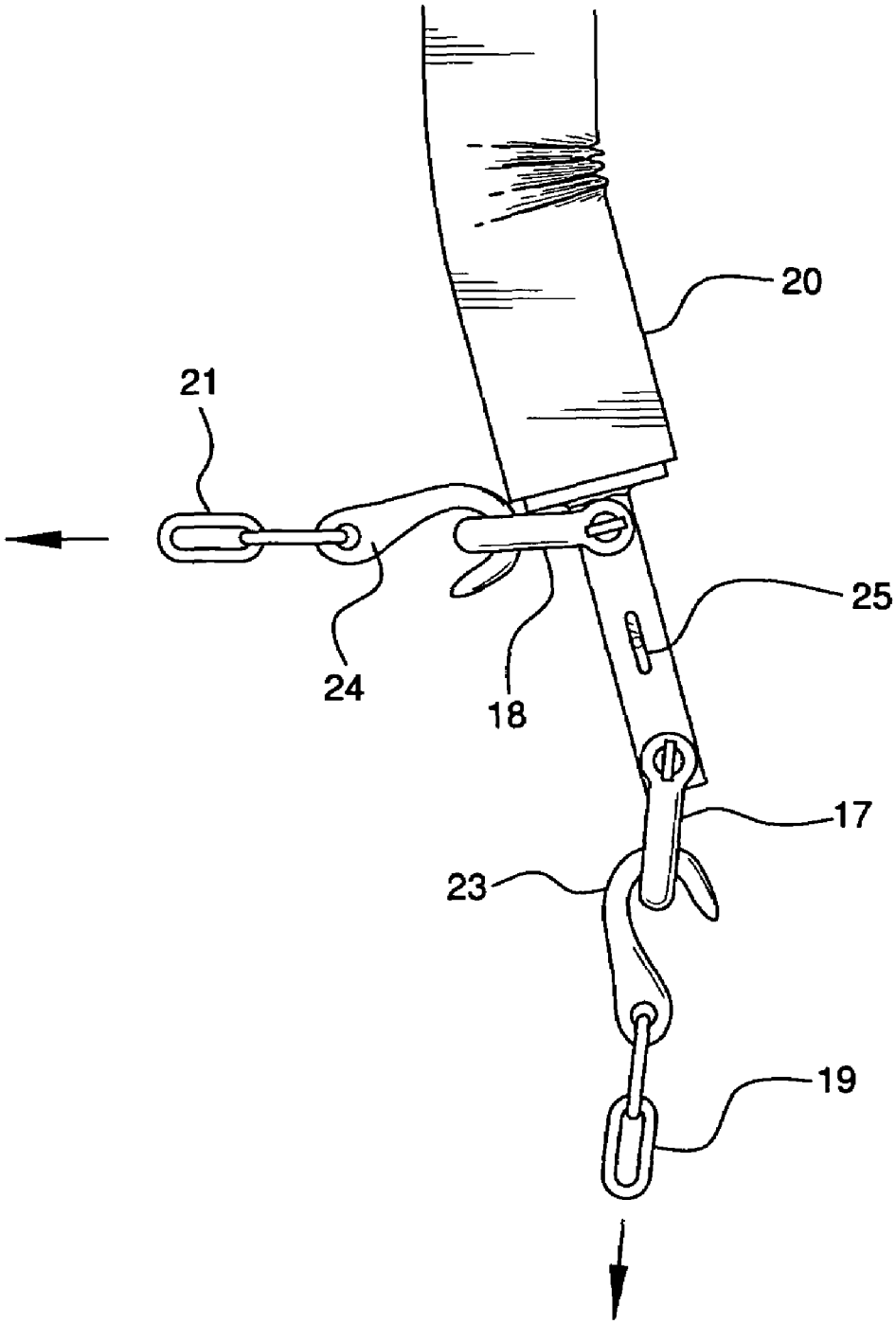
FIG. 6 shows the pull tool of the present invention employing multiple pull chains to straighten a frame rail.

As seen in FIG. 5, when pulling tension is applied to chain 19, via pull post 30, the applied pulling torque will cause the damaged, in this case, crumpled frame 20, to straighten. Application of pulling tension on chain 21 of clamp 18 as seen in FIG. 6, will straighten the angle of damaged frame rail 20. It is also customary to apply heat to the damaged sections of frame rail 20. The heat causes the metal of frame rail 20 to become malleable and more amenable to straightening.

The manner in which pull tool 1 is connected between and directly to sidewalls 22 and 24 of frame rail 20 allows for a more direct pull of the frame rail's infrastructure in the opposite direction to which it was hit, thus allowing a cleaner pull and a setting of the central points of the frame rail back in line. Pull tool 1 is also capable of applying pulling forces in infinitely different directions, i.e., straight back as shown in FIG.5, to any angle to the left side or right side as depicted in FIG. 6, and to any downward or upward angle in relation to frame rail 20. When pull tool 1 is pivoted up, tensioning forces can be applied in upward angles and when pivoted down, the forces can be applied downwardly.

The pull tool of the present invention is described in use in the straightening of a main frame rail of a vehicle. A smaller pull tool, in the same configuration as described, can be used to pull the rear of vehicles which have a smaller frame end opening. It is contemplated that an even smaller size pull tool can be used to repair vehicle cross members or suspension perches.

Thus, the pull tool of the present invention is effectively and efficiently used to repair many different size damaged frame rails and structural components of vehicles. It is clear that pull tool 1 need only be connected to the frame rail once during the frame straightening operation. Once pull post 30 is connected to pull tool 1, using chains, clamps and hooks as described, damaged frame rail 20 can be pulled in tension with a multitude of pulls in any direction necessary to straighten the frame rail, without the need to change or reposition the connecting equipment. The pull tool remains connected to the frame rail with the original pulling equipment throughout the entire process. There is thus a tremendous amount of time saved by eliminating the need to breakdown and reset equipment, in order to pull at different angles. The use of pull tool 1 also prevents the tearing or ripping of metal and thus eliminates the time necessary to repair damaged metal components of the frame rail. Both sides of the frame rail can be pulled with the single positioning of the pull tool, without damaging the metal of the frame rail.

Certain novel features and components of this invention are disclosed in detail in order to make the invention clear in at least one form thereof. However, it is to be clearly understood that the invention as disclosed is not necessarily limited to the exact form and details as disclosed, since it is apparent that various modification and changes may be made without departing from the spirit of the invention.

What is claimed is:

1. A pull tool for straightening a vehicle frame rail with dual sidewalls and an open end, said tool comprising a solid, unitary body, said body having:

a. a first section comprising head means, said head means comprising a single, solid, unitary component having an outer surface and being of given width for insertion into the open end and between the dual sidewalls of the frame rail and further comprising means to secure the head means directly to the dual sidewalls; and b. a second section comprising a solid, unitary, elongated component of given length connected to and extending substantially perpendicularly outward from the outer surface, the length of the elongated component being greater than the width of the head means component and having means through the elongated component for the attachment of at least two pull chains at different locations along the length of the second section and at different angles in relation to the second section, whereby when the tool is secured to the frame rail, the frame rail can be substantially straightened by the use of said at least two pull chains, each placed under a separate tension force and without the need to remove the tool from the frame rail.

2. The pull tool as in claim 1 wherein the means for the attachment of the pull chains comprises a plurality of openings along the length of the second section.

3. The pull tool as in claim 1 wherein the means to secure the head means comprises a through-hole which extends substantially perpendicularly in relation to the dual sidewalls.

4. The pull tool as in claim 3 wherein the means to secure the head means further comprises a bolt extending within the through-hole and through openings in the dual sidewalls, the bolt being secured with a nut to the dual sidewalls.

5. The pull tool as in claim 1 wherein the first section is cylindrical in configuration.

6. A pull tool for straightening a vehicle frame rail with dual sidewalls and an open end, said tool comprising a solid, unitary body, said body comprising:

a. a first section substantially cylindrically in shape comprising a single, solid, unitary component having an outer surface and a width greater than its length, for insertion into the open end and between the dual sidewalls of the frame rail, said first section having a through-hole which extends substantially perpendicularly in relation to the dual sidewalls; and b. a second section comprising a solid, unitary, elongated component of given length connected to and extending substantially perpendicularly outward from the outer surface, the length of the elongated component being greater than the width of the first section component, said second section comprising a plurality of opening means along its length for the attachment of at least two pull chains.

7. The pull tool as in claim 6 further comprising a bolt extending within the through-hole and through openings in the dual sidewalls, the bolt being secured with a nut to the dual sidewalls.

8. The pull tool as in claim 6 wherein the second section is of elongated, boxed shaped configuration.

* * * * *